US009375735B2

(12) United States Patent
van der Steur et al.

(10) Patent No.: US 9,375,735 B2
(45) Date of Patent: Jun. 28, 2016

(54) ROTARY ATOMIZER EDGE GUARD

(71) Applicants: Gunnar van der Steur, Chesapeake City, MD (US); Joseph Cichocki, Newark, DE (US); Stephen Paul Dumelow, Southminster (GB)

(72) Inventors: Gunnar van der Steur, Chesapeake City, MD (US); Joseph Cichocki, Newark, DE (US); Stephen Paul Dumelow, Southminster (GB)

(73) Assignee: EFC Systems, Inc., Havre de Grace, MD (US)

( * ) Notice: Subject to any disclaimer, the term of this patent is extended or adjusted under 35 U.S.C. 154(b) by 193 days.

(21) Appl. No.: 13/999,660

(22) Filed: Mar. 14, 2014

(65) Prior Publication Data

US 2015/0258554 A1 Sep. 17, 2015

(51) Int. Cl.

| | |
|---|---|
| ***B05B 3/10*** | (2006.01) |
| ***B05B 1/28*** | (2006.01) |
| ***B05B 15/02*** | (2006.01) |
| ***B05B 7/08*** | (2006.01) |
| ***B05B 5/04*** | (2006.01) |
| ***B05B 15/00*** | (2006.01) |
| *B05B 15/06* | (2006.01) |

(52) U.S. Cl.

CPC ..... *B05B 3/1014* (2013.01); *B05B 1/28* (2013.01); *B05B 3/1092* (2013.01); *B05B 5/0403* (2013.01); *B05B 7/0815* (2013.01); *B05B 15/001* (2013.01); *B05B 15/02* (2013.01); *B05B 5/0407* (2013.01); *B05B 5/0426* (2013.01); *B05B 15/061* (2013.01)

(58) Field of Classification Search

CPC .. B05B 15/02; B05B 13/1014; B05B 5/0407; B05B 5/0403; B05B 7/0815; B05B 1/28; B05B 15/001; B05B 3/1092; B05B 5/0426; B05B 15/061

USPC ..... 239/104, 223, 224, 288–288.5, 290, 239/699, 700, 703

See application file for complete search history.

(56) References Cited

U.S. PATENT DOCUMENTS

| | | | | |
|---|---|---|---|---|
| 2,784,114 | A * | 3/1957 | Miller | B05B 3/1064 239/223 |
| 5,079,030 | A | 1/1992 | Tomioka et al. | |
| 5,803,372 | A | 9/1998 | Weinstein et al. | |
| 6,042,030 | A * | 3/2000 | Howe | B05B 5/04 239/223 |
| 8,430,340 | B2 | 4/2013 | Herre et al. | |

* cited by examiner

*Primary Examiner* — Steven J Ganey
(74) *Attorney, Agent, or Firm* — E. Alan Uebler, PA

(57) ABSTRACT

The invention relates to rotary bell cup atomizers used in the coating of substrates; more particularly, the invention provides a protective cover for the outer atomizing edge of such devices during idle periods in the coating process, which cover is retractable to expose the atomizing edge and permit unimpeded conventional coating to proceed upon initiation of coating.

16 Claims, 2 Drawing Sheets

ROTARY ATOMIZER EDGE GUARD

FIELD OF THE INVENTION

The invention relates to rotary bell cup atomizers used in the coating of substrates; more particularly, the invention provides a protective cover for the outer atomizing edge of such devices during idle periods in the coating process, which cover is retractable to expose the atomizing edge and permit unimpeded conventional coating to proceed upon initiation of coating.

BACKGROUND OF THE INVENTION

Rotary bell cup atomizers are commonly used in coating operations such as, for example, the painting of vehicle body parts. These coating operations are carried out, in the main, by either robotically mounted and controlled atomizers or by hand-held spray gun atomizers. Both coat various work-pieces by operation of bell cup rotating atomizers affixed thereto.

Rotary atomizers are used in liquid based paint coating operations and bell cup rotary devices are also used in powder coating operations. The invention herein described and claimed is useful in both types, either robotically or machine mounted, or applied via hand held spray gun.

Rotary atomizers which are used in coating the various substrates employ centrifugal forces generated by a rotating bell cup to atomize paint supplied thereto. Pressurized air is directed as an axially-extending shroud around the atomized paint and controls the disposition of paint particles on the work-piece. Electrostatic charging may be used to assist in attracting the atomized particles to the substrate, all of which is known.

Examples of rotary bell cup atomizers are found in prior patents of one of the named inventors herein, specifically in U.S. Pat. Nos. 7,056,397, 6,676,049, and 6,341,734.

Rotary bell cups for atomization are precision instruments, their outer, atomizing edges requiring absolutely flawless precision in order to ensure the flaw-free coating of such substrates as automobile body parts. Imperfections in the coating, termed "dirt" in industry parlance, are unacceptable generally and costly to correct when they do occur. A bell cup having its razor-thin knife edge is highly susceptible to any outside forces acting thereon and producing dings or chips in this fragile edge. While precise movements or robotically controlled atomizers is somewhat less susceptible to damaging nicks and dents than are hand-held spray guns, for obvious reasons, both types of apparatus can and do incur damaging accidental dings and dents during coating operations, the practical result of which can be disastrous to the operation and/or the safety of the operator, requiring complete shutdown, replacement of the damaged cup, and possible discarding or reworking of the flawed work-piece.

The present invention is directed to preventing just such a catastrophic operational event by providing a rotary bell cup atomizer having a protective cover for its atomizing edge, which cover is actuated and extends over the cup edge during idle operation, thereby protecting the edge from external forces during idle, and which retracts to uncover the edge simultaneously with the start of a coating operation, allowing the coating to proceed as normally. On cessation of coating, the cover again extends over the cup edge to protect it.

SUMMARY OF THE INVENTION

An edge-protecting mechanism for protecting the outer atomizing edge of a rotary bell cup atomizer is provided. The apparatus includes a cylindrical tubular cover incorporated into the housing of the atomizing apparatus and extending axially therein, the inside diameter of the cover being greater than the outside diameter of the bell cup. Included are means for extending the cover to a forward position forwardly of the edge during non-atomizing, idling operation of the atomizer, the cover thereby circumferentially covering the atomizing edge of the atomizer, and means for retracting the cover to a rearward position rearwardly of the edge during atomizing operation of the atomizer, thereby exposing the atomizing edge to the environment such that, during atomization, the cover is retracted and atomization proceeds conventionally, and during periods of idle from atomization the cover extends forwardly to the position forward of the edge, thereby protecting the atomizing edge from external damaging forces.

The means for extending and retracting the cover may be one or more of pneumatic, electro-magnetic and mechanical, and may be actuated and idled simultaneously with idling and actuation, respectively, of atomization. The apparatus may be incorporated into a spray gun atomizer or into, inter alia, a robotically mounted rotary atomizer.

In a preferred embodiment, the mechanism includes at least one air channel extending generally axially within the housing from a rearward air supply to an air chamber extending circumferentially around the cover, the cover having a grooved flange therearound, the apparatus including a plurality of air passages therein oriented radially about the cover and extending from the circumferential air chamber rearwardly so as to direct air passing therethrough rearwardly to and against the grooved flange, the air being supplied upon atomization, the force of the air thereby retracting the cover upon and during atomization, and including a bias spring positioned in the apparatus rearwardly of the cover and adjacent thereto such that, upon cessation of atomization and air passage, the cover is extended forwardly to its forward position by action of the bias spring, thereby covering and protecting the edge during idling of the apparatus.

The cover may be constructed of a variety of plastics, ceramics, ferrous and non-ferrous metals, engineered thermoplastics and thermosets, as will be evident to one skilled in the art. Polytetrafluoroethylene and polyoxymethylene are preferred cover materials of construction.

DETAILED DESCRIPTION OF THE INVENTION AND PREFERRED EMBODIMENTS WITH REFERENCE TO THE DRAWINGS

The invention relates to rotary bell cup atomizers used in the coating of substrates; more particularly, the invention provides a protective cover for the outer atomizing edge of such devices during idle periods in the coating process, which cover is retractable to expose the atomizing edge and permit unimpeded conventional coating to proceed upon initiation of coating.

In the most general terms, the invention embodies a protective cover that surrounds the atomizing edge of the bell cup to protect it against damage from accidental contact by external forces or objects. Such a cover is equally useful in both robotically controlled coating operations and for hand-held spray gun atomizers (as well as powder coating devices) but, for presentation purposes here, the detailed description will focus on hand-held spray gun atomizers, while it should be understood that the underlying principles apply to all similar rotary atomizing coating devices.

In the case of the handgun sprayer, when the trigger is pulled to begin a coating painting cycle, the protective cover is caused to retract away from the leading edge of the bell cup. When the trigger is released, ending a painting cycle, the cover is caused to return to its protective position. Generally, any method of returning the cover to its home position and any method of actuating the cover to its protective configuration, i.e., pneumatically, electromagnetically, mechanically, AC/DC power, etc., may all be employed, singly or in combination, without deviating from the basic underlying principles which govern the invention.

Figure 1:
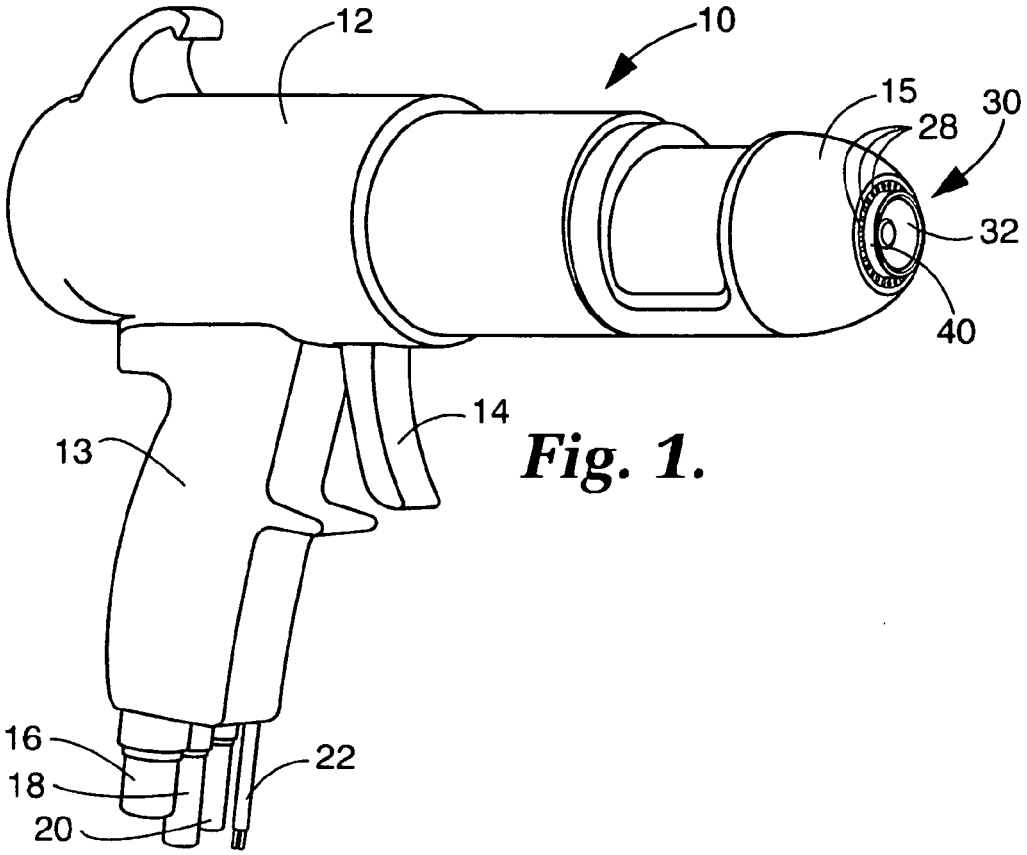
FIG. 1 is a perspective view of a hand-held spray gun rotary bell cup atomizer incorporating the edge-protecting mechanism for protecting the outer atomizing edge of the cup, in accordance with the present invention.

More specifically, FIG. 1 shows a perspective view of a hand-held spray gun rotary atomizing apparatus 10 incorporating the edge-protecting mechanism of the invention, the apparatus including a housing 12 for the operative components, a depending handle 13 for holding and guiding the device, and a spray actuator/trigger 14 for controlling the on/off actuation of a coating operation. Extending into and through the apparatus are a coating/paint supply line 16, a cleaning solvent supply line 18, an air supply line 20 and electrical conduit 22 for imparting charge to atomized paint particles, all components known to those skilled in the art (supply sources not shown).

At the service end of the spray gun 10, the exposed parts of the bell cup atomizing assembly 30 include the rotary atomizing bell cup 32 and the plurality of shaping air conduits 28 oriented circumferentially about the bell cup 32 as shown, through which shaping air is provided during operation to control, shape and shroud the applied coating, the assembly being contained within cover 15. In FIG. 1, the apparatus is shown in the idle, non-spraying mode, and the edge guard 40 according to the invention is seen in its axially forwardly extended position, protruding forwardly of the atomizing edge of the cup 32 and thus covering and protecting the edge of cup 32 from damage caused by external forces.

Figure 2:
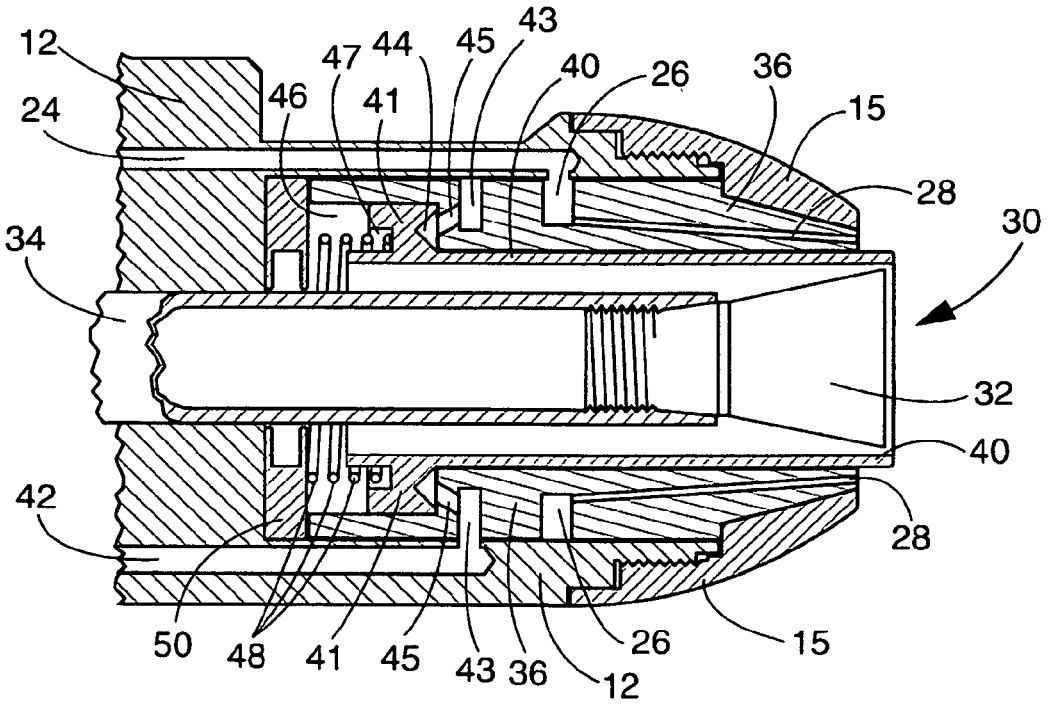
FIG. 2 is an elevational view, partly schematic and partly in cross-section, of one embodiment of a rotary bell cup atomizer showing the edge-protecting mechanism for protecting the outer atomizing edge of the cup depicted in the cover-extended, "idle" non-spraying mode of operation.

In FIG. 2, an elevational view, partly schematic and partly in cross-section, the apparatus of the invention is depicted also in the "idle", non-spraying mode of operation. In FIG. 2, components shown therein which are common with components of FIG. 1 are represented by common numbers. With reference to FIG. 2, the rotary bell cup assembly 30 is shown schematically to include the rotary bell cup 32 affixed to motor shaft 34 and conventionally driven by a turbine (not shown), the details of which are omitted, i.e., the coating, air, cleaning solvent and electrical conduit are omitted for clarity of illustration.

Relative to the invention, a cylindrical edge guard cover 40 incorporated into the apparatus as shown in FIG. 2 extends axially over and circumferentially around the bell cup assembly 30 and, in the idle mode depicted, the cover 40 protrudes forwardly and outwardly, extending forwardly beyond the atomizing edge of the cup 32, all as shown. The edge guard 40, in the preferred embodiment shown, proximate its rearward end, has a flange-like member 41 protruding outwardly therefrom, described more fully below. The edge guard 40 is slidable within the housing 36 of the apparatus and, in the idle mode depicted, is held in the extended, forward, edge-protected configuration as shown, by the bias spring 48. A circumferential groove/air channel 44 and spring groove 47 in the flange 44 are described in more detail in connection with FIG. 4 below.

Still referring to FIG. 2, air line 20 connects to shaping air channel 24 which leads to circumferential annular air channel 26 from which the plurality of shaping air passages 28 extend and exit circumferentially about the cover 40 as shown. From the air main supply (not shown), air channel 42 leads into the circumferential air chamber 43 in housing 36 and connects a plurality of air passages 45, rearwardly extending therefrom as shown, and opening into a groove 44 in the flange 41, which groove 44 provides a circumferential air channel about the edge guard 40. Bearing 50 is included for completeness, and the function of and interaction among the described components is described in the following.

Figure 3:
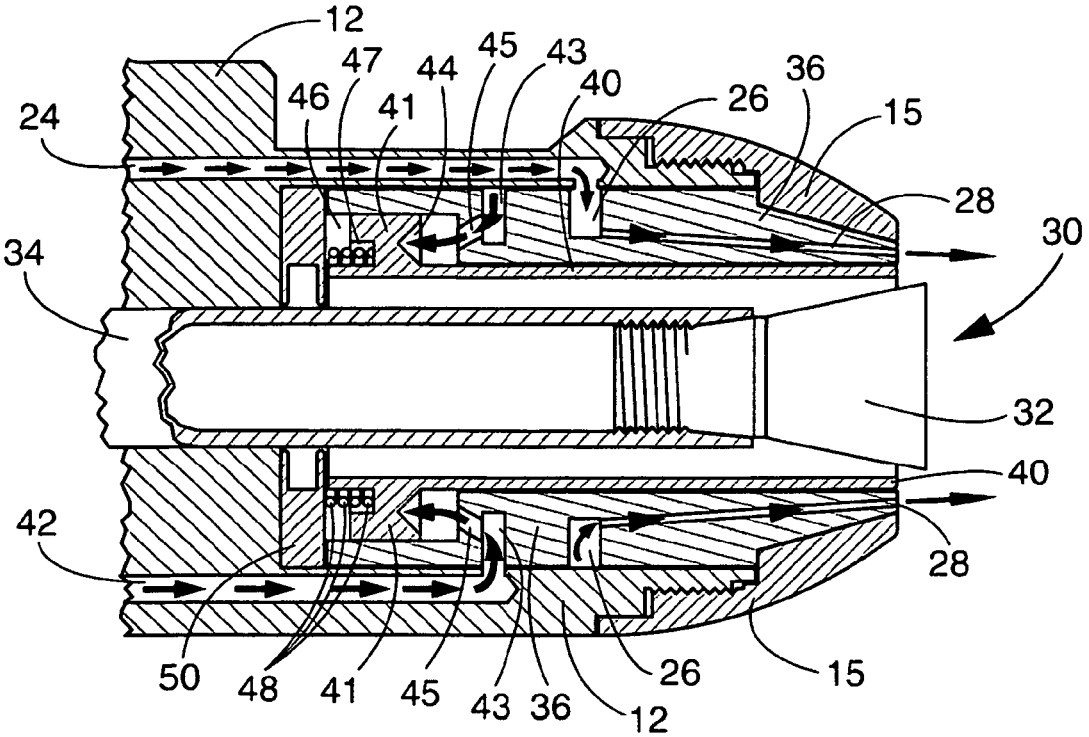
FIG. 3 is an elevational view, partly schematic and partly in cross-section, of the rotary bell cup atomizer of FIG. 2 depicted in the cover-retracted, operational spraying mode of operation.

In FIG. 3, an elevational view, partly schematic and partly in cross-section, the apparatus of the invention is shown in its operational, spray painting mode. Therein, upon commencing spraying by actuation of trigger 14 (not shown), thereby initiating the supply of paint (not shown) and electrical connections, air enters conduits 24 and 42. The air entering passage 24 is carried through annular channel 26 and then into and through the plurality of shaping air conduits 28 in the conventional manner, to control and shroud the paint being applied to a work-piece. Simultaneously, air entering passageway 42 is passed into circumferential air chamber 43, thence into and through the multiple passages 45, from which the air exits and impinges as shown upon the flange 41, specifically into the groove 44 in flange 41. The air pressure and the bias spring force are counter-balanced such that cover 40 is slidably and pneumatically thereby retracted to the position shown in FIG. 3, with bias spring 48 compressed, and cover 40 in its retracted orientation, uncovering and exposing the forward atomizing edge of bell cup 32 as shown, thereby to permit the painting/coating operation to proceed otherwise conventionally.

Figure 4:
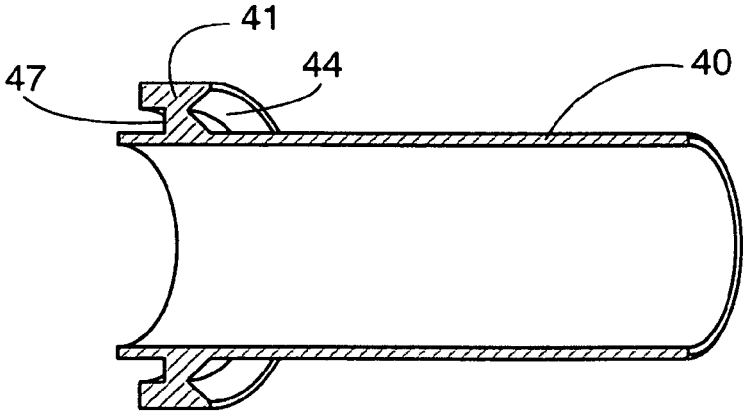
FIG. 4 is a side elevational, perspective cross-sectional view of one embodiment of the rotary atomizer edge-protecting cover according to the invention.

FIG. 4, in a side elevational perspective cross-sectional view, shows the rotary atomizer edge guard of the invention as described hereinabove. The edge guard shown includes cylindrical edge cover 40 and flange member 41, in which circumferential groove 44 is included in the forward face of flange 41 and rearward groove 47 is included to accommodate the bias spring 48 on retraction of the edge guard. Neither groove is essential to the invention, but both are preferred.

Upon cessation of coating by release of trigger 14 (FIG. 1), paint and air supplies are cut off, cover 40 returns to its forward extended position (FIG. 2) by action of bias spring 48, and the forward edge of bell cup 32 is once again protected from external forces.

While the invention has been described above with specific reference to pneumatic activation of the edge guard, it will be clear to one skilled in the art that other activation means are possible and are contemplated to be within the scope of the invention and the claims herein, specifically including mechanical means, electro-magnetic means, and combinations of pneumatic, electro-magnetic and mechanical means.

The basic principles governing the invention are mechanical and hydrodynamic in nature, and a wide range of materials of construction of the edge guard described herein will be evident to a skilled artisan. With that in mind, suitable materials of construction of the guard will include a variety of plastics, ceramics and metals, including engineered thermoplastics, for example polyoxymethylene (POM, trade name "DELRIN"), thermosets, ferrous and non-ferrous metals, and others. Aluminum, steel, and various structural composites should also be suitable. Polytetrafluoroethylene is another preferred material owing to its inertness.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An edge-protecting mechanism for protecting the outer atomizing edge of a rotary bell cup atomizer in rotary bell cup atomizing apparatus comprising:

a cylindrical tubular cover incorporated into the housing of said atomizing apparatus and extending axially therein, the inside diameter of said cover being greater than the outside diameter of said bell cup, and means for extending said cover to a forward position forwardly of said edge during non-atomizing idling operation of said atomizer, the cover thereby circumferentially covering the atomizing edge of said atomizer, and including at least one air channel extending generally axially within said housing from a rearward air supply to an air chamber extending circumferentially around said cover, said cover having a flange therearound, the apparatus including a plurality of air passages therein oriented radially about said cover and extending from said circumferential air chamber rearwardly so as to direct air passing therethrough rearwardly to and against said flange, said air being supplied upon atomization, the force of said air thereby retracting said cover upon and during atomization, to pneumatically retract said cover to a rearward position rearwardly of said edge during atomizing operation of said atomizer, thereby exposing the atomizing edge to the environment, whereby, during atomization said cover is retracted and atomization proceeds conventionally, and during periods of idle from atomization said cover extends forwardly to said position forward of said edge, thereby protecting said atomizing edge from external damaging forces.

2. The edge-protecting mechanism of claim 1 wherein said means for extending said cover are mechanical.

3. The edge-protecting mechanism of claim 2 including a bias spring positioned in said apparatus rearwardly of said cover and adjacent thereto such that, upon cessation of atomization and air passage, said cover is extended forwardly to its forward position by said bias spring, thereby covering and protecting said edge during idling of said apparatus.

4. The edge-protecting mechanism of claim 1 wherein said means for extending and retracting said cover are actuated and idled simultaneously with idling and actuation, respectively, of atomization.

5. The edge-protecting mechanism of claim 1 wherein said atomizing apparatus is a spray gun.

6. The edge-protecting mechanism of claim 1 wherein said atomizing apparatus is a robotically mounted rotary atomizer.

7. The edge-protecting mechanism of claim 1 wherein said flange has a groove formed in the forward face thereof into which the air passing through said air passages is directed.

8. The edge-protecting mechanism of claim 1 wherein said flange is a grooved flange, and including a bias spring positioned in said apparatus rearwardly of said cover and adjacent thereto such that, upon cessation of atomization and air passage, said cover is extended forwardly to its forward position by said bias spring, thereby covering and protecting said edge during idling of said apparatus.

9. The edge-protecting mechanism of claim 1 wherein said cover is constructed of a material selected from the class consisting of plastics, ceramics and metals.

10. The edge-protecting mechanism of claim 9 wherein said cover is constructed of a ferrous metal.

11. The edge-protecting mechanism of claim 9 wherein said cover is constructed of a non-ferrous metal.

12. The edge-protecting mechanism of claim 11 wherein said cover is constructed of aluminum.

13. The edge-protecting mechanism of claim 9 wherein said cover is constructed of an engineered thermoplastic.

14. The edge-protecting mechanism of claim 13 wherein said cover is constructed of polyoxymethylene.

15. The edge-protecting mechanism of claim 9 wherein said cover is constructed of an engineered thermoset.

16. The edge-protecting mechanism of claim 9 wherein said cover is constructed of polytetrafluoroethylene.

* * * * *